US006052660A

United States Patent [19]

Sano

[11] Patent Number: 6,052,660

[45] Date of Patent: Apr. 18, 2000

[54] ADAPTIVE CODEBOOK

[75] Inventor: Hideo Sano, Tokyo, Japan

[73] Assignee: NEC Corporation, Tokyo, Japan

[21] Appl. No.: 09/097,649

[22] Filed: Jun. 16, 1998

[30] Foreign Application Priority Data

Jun. 16, 1997 [JP] Japan ..... 9-158174

[51] Int. Cl.[7] ..... G10L 19/12

[52] U.S. Cl. ..... 704/221; 704/223

[58] Field of Search ..... 704/219, 223, 704/262, 264, 221, 222

[56] References Cited

U.S. PATENT DOCUMENTS

| | | | |
|---|---|---|---|
| 4,899,385 | 2/1990 | Ketchum et al. | 704/223 |
| 5,596,676 | 1/1997 | Swaminathan et al. | 704/208 |
| 5,699,478 | 12/1997 | Nahumi | 704/226 |
| 5,724,480 | 3/1998 | Yamaura | 704/219 |
| 5,732,389 | 3/1998 | Kroon et al. | 704/223 |
| 5,752,223 | 5/1998 | Aoyagi et al. | 704/219 |
| 5,774,838 | 6/1998 | Miseki et al. | 704/222 |
| 5,864,797 | 1/1999 | Fujimoto | 704/223 |
| 5,867,814 | 2/1999 | Yong | 704/216 |
| 5,884,251 | 3/1999 | Kim et al. | 704/219 |

FOREIGN PATENT DOCUMENTS

| | | |
|---|---|---|
| 0 459 358 | 12/1991 | European Pat. Off. . |
| 0 714 089 | 5/1996 | European Pat. Off. . |
| 8-227300 | 10/1995 | Japan . |

OTHER PUBLICATIONS

Gerson, "Vector Sum Excited Linear Prediction (VSELP) Speech Coding For Japan Digital Cellular" *IEICE* pp. 35–40 (1990).

*Primary Examiner*—David R. Hudspeth
*Assistant Examiner*—Martin Lerner
*Attorney, Agent, or Firm*—Foley & Lardner

[57] ABSTRACT

In a CELP system, a coder and a decoder have identical codebooks, and the amount of data to be transmitted is compressed by transmission and reception of codebook indexes. Past excitation signals are stored in a memory and used as an adaptive codebook to improve the speech quality. The coder and the decoder each comprise memory means for storing index data for at least one frame, and means for generating an adaptive codebook afresh by initialization to zero for each frame when generating an excitation signal according to stored indexes.

2 Claims, 5 Drawing Sheets

ADAPTIVE CODEBOOK

BACKGROUND OF THE INVENTION

The present invention relates to adaptive codebooks for signal generation according to indexes. More specifically, the present invention relates to speech coding techniques using communication systems or radio communication systems based on packet exchange network, particularly to adaptive codebooks used for emphasizing pitch components.

Many communication systems such as cellular communication systems or personal communication systems are based on radio channels for data communication. In such data communication, the radio channel is affected by some error sources such as multi-path fading. Such error sources may give rise to a problem of frame missing. By the term "missing" is meant total or partial destruction of the group of bits transmitted to the receiver. By the term "frame" is meant a fixed number of bits dealt with as an entity for communication in a communication system.

In the event of perfect missing of the bits of one frame, the receiver no longer has any bit for interpretation. In such an occasion, the receiver may generate a meaningless result. When the received frame is destroyed and thus unreliable, the receiver may generate an extremely distorted result. Increasing demand for the radio system capacity has given rise to the necessity of utmost utilization of the radio system bandwidth capable of being utilized. One method for improving the system bandwidth utility efficiency is to use signal compression techniques. In a radio system for transmitting a speech signal, speech compression (or speech coding) techniques may be used to this end. Such a speech coding technique is implemented by a synthesized speech coder based on analysis, such as well-known Code Excited Linear Prediction speech coder.

The problem of packet missing in a packet exchange network adopting a speech coding system is very analogous to the frame missing in the case of radio communication. Specifically, in the event of packet missing, the receiver, that is, speech decoder may no longer be able to receive frame or receive a frame with a missing of a considerable number of bits. In either case, the speech decoder presents essentially the same problem; that is, the speech decoder should synthesize speech in spite of missing of compressed speech data. Both the "frame missing" and "packet missing" concern the problem in communication channel (or network) to bring about missing of transmitted bits. In the following description, the term "frame missing" may be regarded to be a synonym of the packet missing.

A CELP speech coder uses an excitation signal codebook for coding an original speech signal. The excitation signals are used for "exciting" a linear prediction (LPC) filter for synthesizing a speech signal (or some precursor thereto). The synthesized speech signal is compared with the signal to be coded. A codebook index which is most identical with the original signal is transmitted to the CELP decoder. Communication of other type data may be made in dependence on the type of the CELP system. For the brevity of description, in the present specification the indexes and data obtained as a result of code correction or like process on the indexes are thus generally described as "index data".

In the prior art CELP coder, excitation signals are generated with a structure as shown in FIG. 3, as is well known in, for instance, "Vector Sum Excited Linear Prediction (VSELP) Speech Coding for Japan Digital Cellular", RCS90-26, (TRREDCE) Technical Research Reports of the Institute of Electronics and Data Communication Engineers of Japan.

FIG. 3 is a block diagram illustrating the excitation signal generation described in the reports, i.e., a summary of typical excitation signal generation. Referring to the Figure, a multiplier 302 adjusts the output signal level of a fixed codebook 301 by multiplying the signal by a gain Gc. Another multiplier 304 adjusts the output signal level of an adaptive codebook 303 by multiplying the signal by a gain Gp. An adder 305 adds together the two level adjusted signals to generate an excitation signal. The excitation signal thus generated is fed back to the adaptive codebook to realize reproduction of the pitch lag of speech. Generally, the transfer function of the adaptive codebook is given as:

$$P1(z)=GpZ^{-P},$$

where p is the group delay, i.e., pitch lag. In the excitation signal generation, the CELP speech coder makes a retrieval for the best identical index to the input speech signal. In FIG. 3, the best identical indexes in the current frame are labeled I fcb curr and I acb curr, and the gains obtained as a result of conversion of the indexes I Gc curr and I Gp curr concerning the gain are labeled Gc curr and Gp curr. The CELP speech decoder receives the most identical data from the CELP speech coder and, like the coder, generates an excitation signal. However, generation of an error in the transmission line due to multi-pulse fading or the like, results in frame missing and deterioration of the speech quality.

Heretofore, "a method of improving the performance of coding systems" which is disclosed in Japanese Laid-Open Patent Publication 8-227300, has been well known as a method of improving the performance of coding systems against frame missing.

FIG. 4 shows a prior art radio communication system disclosed in this Laid-Open Patent Publication.

Referring to the Figure, the illustrated ratio communication system comprises a G.728 speech coder 401, a decoder pre-processor 403 and a G.728 speech decoder 404.

The G.728 speech coder 401 codes input speech, and transmits coded speech signal thus obtained to a communication channel 402. The coded speech signal is affected by some error sources such as multi-fading as it is passed through the communication channel 402, and received as coded speech signal with frame missing in the decoder pre-processor 403. The decoder pre-processor 403 "decodes" missing-frame-free coded speech signal in a range necessary for the generation of an excitation signal which is also generated in the coder. When frame missing is recognized, a "decoded" excitation signal of the preceding frame is externally inserted throughout the period of the missing frame. The externally inserted excitation signal is coded by using the best codebook identity that can be utilized, and is made so by executing a series of codebook "retrievals". Particularly, a codebook vector which is most identical with each vector of the externally inserted excitation signal is selected. The pre-processor discriminates the index that represents the best codebook, and generates the coded speech signal based on this index. Using this correction signal, the decoder can approximate the externally inserted excitation signal from the pre-processor, thus minimizing the advantages of destroyed frames in the reconstituted speech signal.

FIG. 5 is a flow chart concerning the operation of the decoder pre-processor. In this example, the CELP speech coder is used, and a target signal is selected as being an excitation signal, which is constituted by external insertion of an excitation signal represented by coded signal corresponding to the preceding frame. The pre-processor "decodes" missing-frame-free coded speech signal in a range necessary for the excitation signal generation. In other words, it executes the same codebook lookup as executed in the excitation signal generator 405 in the decoder. This means that the pre-processor 403 includes the same codebook as that present in both the coder and decoder. When a missing frame is recognized, the pre-processor 403 externally inserts the decoded excitation signal corresponding to the preceding frame inserted in the missing frame period. Subsequently, the (best identical) codebook index representing the externally inserted excitation signal is generated by executing codebook retrieval.

With reference to FIG. 4, the pre-processor 403, receiving each frame from the communication channel 402 (step 500), checks whether the coded speech signal corresponding to the received frame has been destroyed (step 501). The check may be made by using a usual error detection signal. When the pre-processor 403 determines that the given frame has not been destroyed (step 502), it supplies the coded speech signal without correction to the decoder 404 (step 503). The pre-processor 403 executes codebook lookup for each codebook index contained in the given frame and, as a result, generates and stores an excitation signal (step 504). This process is essentially the same as executed by the excitation signal generator 405 in the decoder 404 shown in FIG. 3. The stored data is preserved for being used in the next frame process (when it is found that the next frame is a missing frame).

When the pre-processor 403 recognizes in the step 502 that the given frame has been destroyed, it executes the steps 505 to 507. In the step 505, the pre-processor 403 corrects the coded speech signal. Specifically, in this step the pre-processor 403 executes external insertion of the excitation signal of the preceding frame (i.e., the signal decoded and stored in the step 500) as a corrected signal corresponding to the pertinent frame.

In the next step 506, the pre-processor 403 executes the "coding" of the externally inserted excitation signal. Specifically, the pre-processor 403 executes codebook retrieval for the best identical codebook entry with the externally inserted signal. Codebook is retrieved for each vector of the missing frame and the entry which is the best identical with the part corresponding to the externally inserted excitation signal. The reference of the best identity may be based on the mean square error measure or other error references well known to the person skilled in the art.

Finally, in the step 507 the pre-processor 403 replaces the missing frame part of the coded speech signal with the codebook index generated in the step 506. Using this codebook index; the decoder can generate an excitation signal which approximates the externally inserted excitation signal generated in the step 505, thus permitting improvement of the performance of the coding system. After the pre-processor 403 has transmitted the coded speech signal to the decoder in the step 503 (and generated the excitation signal in the step 504), or after it has corrected the coded speech signal in the steps 505 to 507, the control routine returns to the step 500 to receive the next frame.

In the technique as described above, in the event of the occurrence of a transmission line error on the communication channel, the internal states of the adaptive codebooks of the coder and decoder may fail to be identical. The occurrence of such identify failure may result in abnormal sound generation and deterioration of the speech quality when the decoder executes decoding by receiving the index transmitted from the coder, even though retrieval for the best identical index is made on the coder side.

This is so because of the fact that the adaptive codebook has a feedback constitution that an adaptive codebook is generated by using the excitation signal of the preceding frame. Due to an error occurring during voiced speech, the internal state of the adaptive codebook of the decoder becomes different from that of the adaptive codebook of the coder. When the signal level is reduced in such a case as when a non-voice state is brought about, the signal level of the adaptive codebook internal state is also reduced, so that an error occurring on the transmission line of course has less adverse advantages. An error occurring on the transmission line during a voiced speech signal period, however, has advantages continuous to a non-voice period due to feedback loop. During the period until the non-voice period sets in after occurrence of a transmission line error, the index combination may lead to generation of abnormal noise and extreme deterioration of the speech quality.

SUMMARY OF THE INVENTION

An object of the present invention, therefore, is to improve the speech quality by reducing abnormal sound due to identity failure of the internal states of adaptive codebooks of the coder and decoder, in which abnormal sound may occur even in the absence of any transmission error after occurrence of a previous identify failure due to a transmission line error.

According to an aspect of the present invention, there is provided an adaptive codebook, in a coder of CELP for coding a speech signal or audio signal to index data, and also in a decoder for decoding the index data to the speech signal or audio signal, a codebook for signal generation according to the index, comprising memory means for storing index data transmitted and received between the coder and the decoder for at least one frame, index data stored in the memory means being used to generate an excitation signal, signal series thus generated being used as an adaptive codebook.

The excitation signal generation based on index data for at least one frame stored in the memory means is caused after clearing last excitation signal memory contents in the memory means.

According to another aspect of the present invention, there is provided an adaptive codebook in a coder of CELP for coding a speech signal or audio signal to index data, and also in a decoder for decoding the index data to the speech signal or audio signal comprising: index memory means for providing fixed codebook index preceding by i frames, adaptive codebook index and gain index; a fixed codebook for providing a signal series according to the data of fixed codebook index preceding by i frames; an excitation signal memory means for providing a signal series according to the data of adaptive codebook index preceding by i frames; an excitation signal generator for generating signal of at least one frame by using the outputs of the fixed codebook and excitation signal memory and the gain index; and an adaptive codebook for producing an adaptive codebook on the basis of the output of the excitation signal memory, wherein the data in the excitation signal memory means is updated according to the excitation signal.

All the data in the excitation signal memory means is set to zero or to known data before the commencement of the excitation signal production of the current frame.

The excitation signal generator generates the signal on the basis of the summed signal of the gain controlled outputs of the fixed codebook and excitation signal memory. The index memory is constituted by a RAM, the fixed codebook is constituted by a ROM in which a noise signal series has been written, and the excitation signal memory is constituted by a RAM.

According to other aspect of the present invention, there is provided a coder having the foregoing adaptive codebook comprising: an adaptive codebook for producing an excitation vector signal corresponding to pitch vector including a component dependent on the periodicity of the speech signal; a fixed codebook for producing an excitation output vector corresponding to codevector of a non-periodic component; multiplier for multiplying the excitation vector signal and excitation output vector by respective gains; an adder for generating an excitation signal of the current frame by adding together the two product outputs of the multipliers; a synthesizing filter for generating a reproduced signal based on the excitation signal of the current frame; a subtracter, responsive to the reproduced signal, for producing an error between the reproduced signal and an input signal; and an error power evaluator for controlling and scanning the outputs of the adaptive and fixed codebooks and the gains of the multipliers for each frame, and producing an excitation signal corresponding to a minimum error to be the optimal excitation signal.

According to still other aspect of the present invention, there is provided a decoder having the foregoing adaptive codebook comprising: an adaptive codebook for producing an excitation vector signal corresponding to pitch vector including a component dependent on the periodicity of the speech signal; a fixed codebook for producing an excitation output vector corresponding to codevector of a non-periodic component; multiplier for multiplying the excitation vector signal and excitation output vector by respective gains; an adder for generating an excitation signal of the current frame by adding together the two product outputs of the multipliers; a synthesizing filter for generating a reproduced signal based on the excitation signal of the current frame; and a post-filter, cascade connected to the output of the synthesizing filter, for generating a reconstituted speech signal.

According to other aspect of the present invention, there is provided an adaptive codebook, in a CELP system as a speech coding system, a coder and a decoder have identical codebooks, and the amount of data to be transmitted is compressed by transmission and reception of codebook indexes, past excitation signals are stored in a memory and used as an adaptive codebook, the coder and the decoder each comprise memory means for storing index data for at least one frame, and means for generating an adaptive codebook afresh by initialization to zero for each frame when generating an excitation signal according to stored indexes.

In the adaptive codebook for signal generation based on indexes according to the present invention, the excitation signal generating means produces the adaptive code width afresh from index data in a certain past period of time. Thus, when no error occurs for several continuous frames after occurrence of a transmission line error, it is possible to make the internal states of the adaptive codebooks of the coder and decoder identical.

Other objects and features will be clarified from the following description with reference to attached drawings.

PREFERRED EMBODIMENTS OF THE INVENTION

Figure 1:
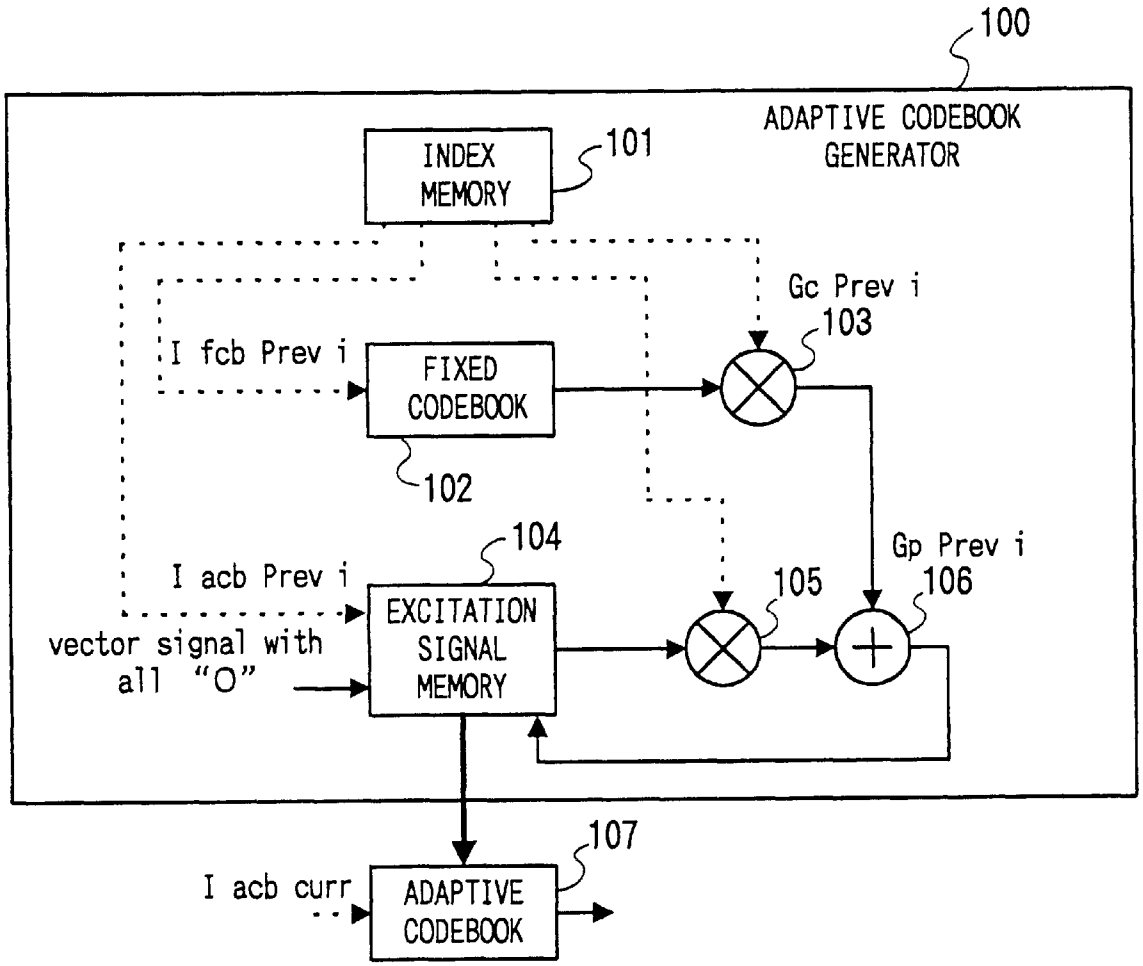
FIG. 1 is a block diagram showing an adaptive codebook generator according to an embodiment of the present invention.

An embodiment of the present invention will now be described with reference to the drawings. Referring to FIG. 1, the best form of the present invention comprises a fixed codebook, an excitation signal memory means, gain control means for controlling the levels of the output signals of the fixed codebook and the excitation signal memory means, a synthesizing means for combining the gain controlled signals, and an excitation signal memory means for receiving a resultant excitation signal output of the synthesizing means. Index memory means supplies necessary past frame indexes to the fixed codebook, the excitation signal memory means and the individual gain control means. The internal state data of the excitation signal memory means is supplied to the adaptive codebook after generation of at least one preceding frame excitation signal.

The fixed codebook, the adaptive codebook, the excitation memory means and the index memory means are formed as memory means. The fixed codebook is desirably constituted by a ROM. The adaptive codebook, the excitation memory means and the index memory means are desirably constituted by RAMs as tentative memory means. The gain control means is desirably constituted by a multiplier. The synthesizing means is desirably constituted by an adder.

The fixed codebook is not particularly limitative, and it may contain noise signal series, pulse signal series, etc. stored in it.

The operation of the embodiment of the present invention will now be described in detail with reference to the drawings.

Adaptive codebook generating means 100 comprises an index memory means 101, a fixed codebook 102, an excitation signal memory means 104, gain control means 103 and 105 and a synthesizing means 106.

The index memory means 101 supplies fixed codebook index I fcb prev i preceding by i frames to the fixed codebook 102, adaptive codebook index I acb prev i to the excitation signal memory means 104, gain indexes I Gc prev i and I Gp prev i to the gain control means 103 and 105. The gain indexes are converted to gains Gc Prev i and Gp prev i by table lookup of the gain codebook. The index memory means may store data obtained as a result of conversion of coded speech signal (i.e., index) according to error correction code and also data obtained as a result of table conversion and various other data conversions, as well as the best identical index.

The fixed codebook 102 provides a signal series through table lookup according to the data of fixed codebook index I fcb prev i preceding by 1 frames, supplied from the index memory means 101. The excitation signal memory means 104 provides a signal series through table lookup according to the data of adaptive codebook index I acb prev i preceding by 1 frames, supplied from the index memory means 101. One of important feature of the present invention resides in that, before the commencement of the excitation signal generation of the current frame, all the data in the excitation signal memory means is set to zero or to known data (for instance, data of a certain fixed pattern), and then signal of at least one frame is generated by using past index.

The gain controller 103 gain controls the output signal of the fixed codebook 102, and the gain controller 105 gain controls the output signal of the excitation signal memory means 104. The synthesizing means 106 combines the two gain controlled signals, and thus generates a resultant excitation signal. The excitation signal memory means 104 receives this excitation signal, and updates its internal state.

Likewise, excitation signals are generated by using indexes previous by (i−1) frames to one frame, received from the index memory means 101.

The updated internal state data of the excitation signal memory means 104 is supplied to the adaptive codebook 107 and used as a codebook of the current frame.

The embodiment of the invention will now be described with reference to the drawings. Referring to FIG. 1, the embodiment of the present invention comprises a fixed codebook, an excitation signal memory, multipliers for controlling the levels of the output signals of the fixed codebook and the excitation signal memory, and an adder for combining the gain controlled signals, the output of the adder being fed back to the excitation signal memory. The index memory outputs the past index to the fixed codebook, excitation signal memory and respective multipliers. The internal state data of the excitation signal memory is supplied to the adaptive codebook after generation of excitation signal of at least one preceding frame.

The operation of the embodiment of the present invention will now be described with reference to FIG. 1. Referring to FIG. 1, the adaptive codebook generator 100 comprises the index memory 101, fixed codebok 102, excitation signal memory 104, multipliers 103 and 105 and adder 106.

The index memory 101 is constituted by a RAM, and stores indexes of 10 frames. Of indexes read out from the index memory, fixed codebook index I fcb prev i preceding by i frames is supplied to the fixed codebook 102, the adaptive codebook index I acb prev i is supplied to the excitation signal memory 104, and gain indexes I Gc prev i and Gp prev i are supplied to the multipliers 103 and 105, respectively. The gain indexes are converted to gains Gc prev i and Gp prev i by table lookup of the gain codebook.

The fixed codebook 102 is constituted by a ROM, in which a noise signal series has been written. The noise signal series is supplied by table lookup based on data of fixed codebook index I fcb prev i preceding by i frames, supplied from the index memory 101. The excitation signal memory 104 is constituted by a RAM, and the signal series is supplied by table lookup based on data of adaptive codebook index I acb prev i, supplied from the index memory 101. The excitation signal memory 104, when starting the generation of the excitation signal of the current frame, sets all the data in the excitation signal memory 104 to zero, and then generates at least one frame signal by using past index.

The multiplier 103 gain controls the output signal (i.e., noise signal series) of the fixed codebook 102, and the multiplier 105 gain controls the output signal (i.e., signal series) of the excitation signal memory 104. The adder 106 generates the excitation signal by adding together the two gain controlled signals. The excitation signal memory 104 updates its internal state by receiving the excitation signal. Excitation signals are generated likewise by using indexes preceding by (i−1) frames to one frame, received from the index memory 101.

Data of the excitation signal memory internal state updated in the above way, is supplied as codebook of the current frame to the adaptive codebook 107.

Figure 2:
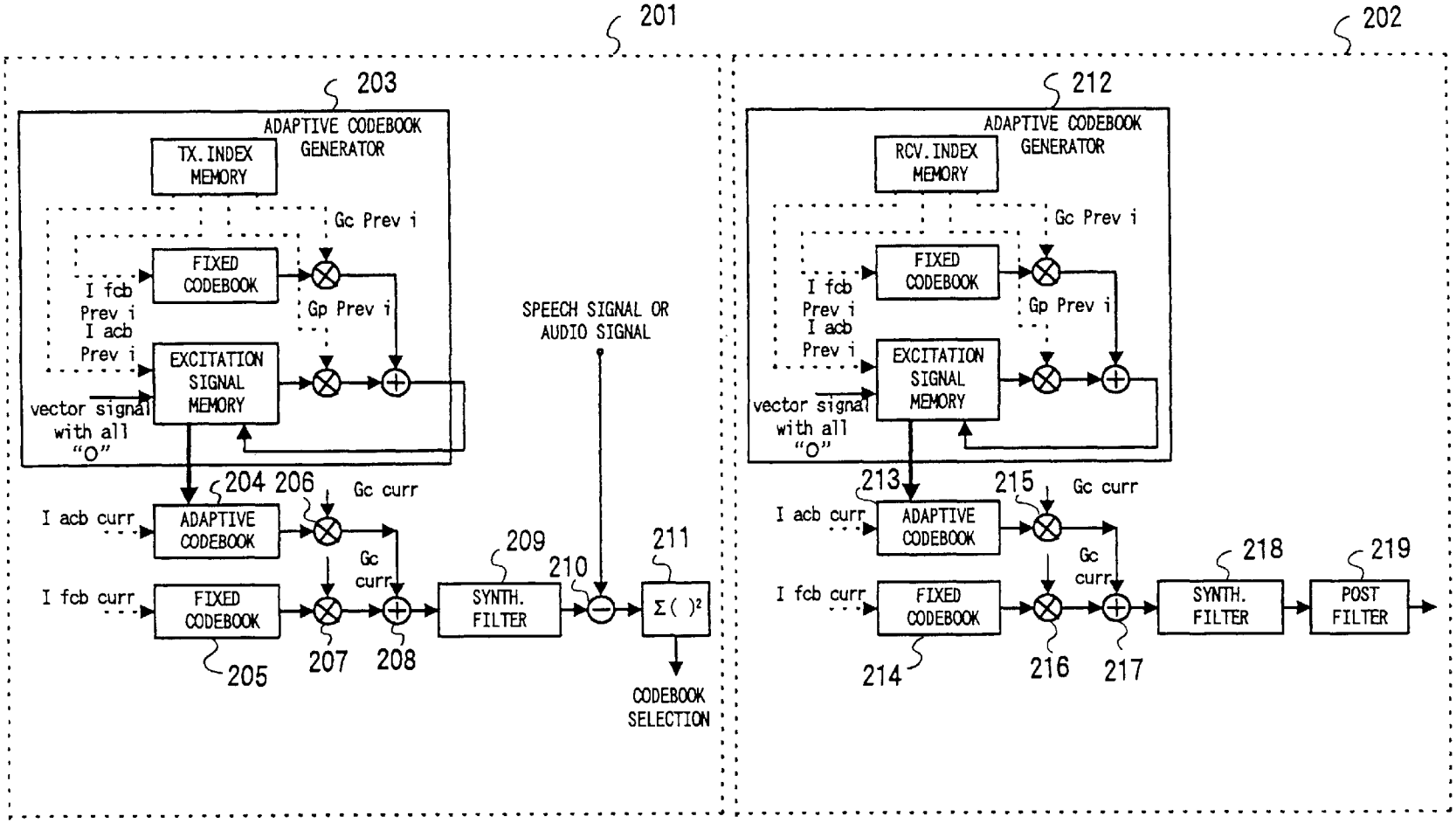
FIG. 2 is a block diagram showing a coder embodying the present invention.
Figure 3:
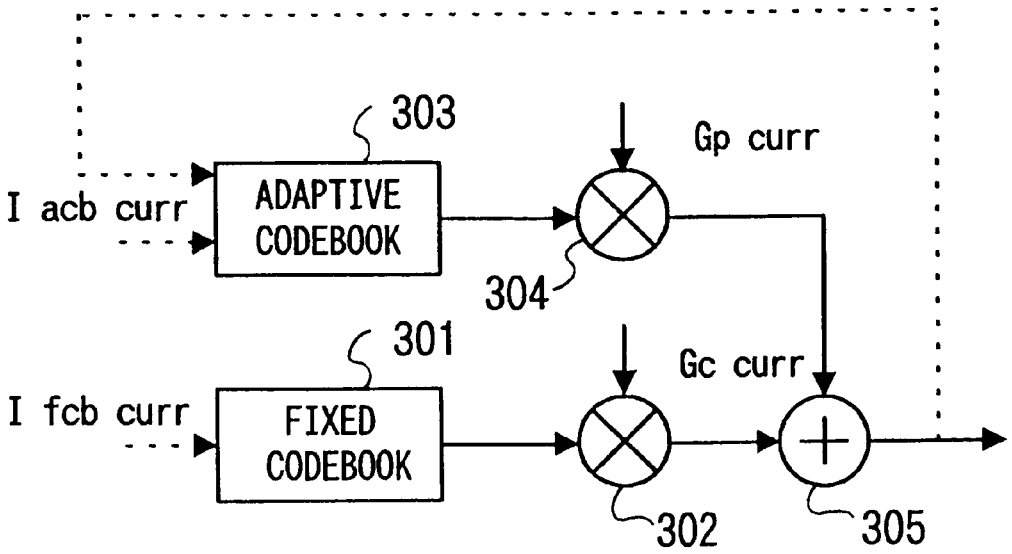
FIG. 3 (PRIOR ART)
FIG. 3 is a block diagram illustrating prior art excitation signal generator.
Figure 4:
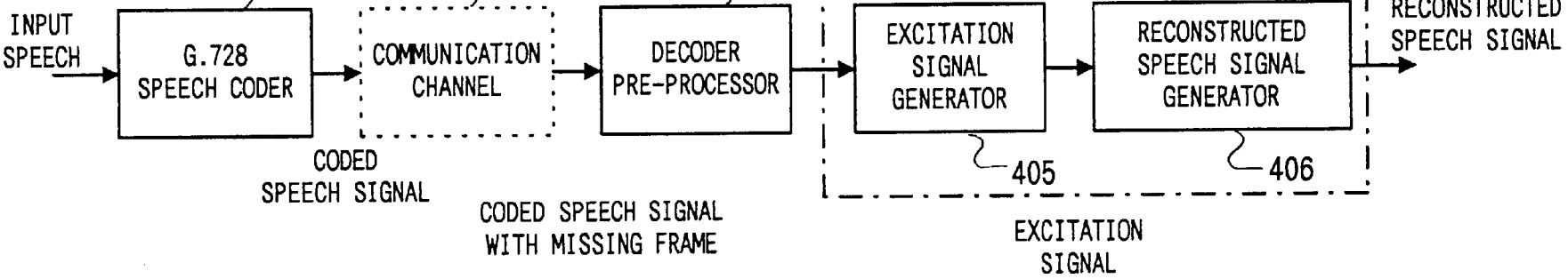
FIG. 4 (PRIOR ART)
FIG. 4 shows a prior art radio communication system.
Figure 5:
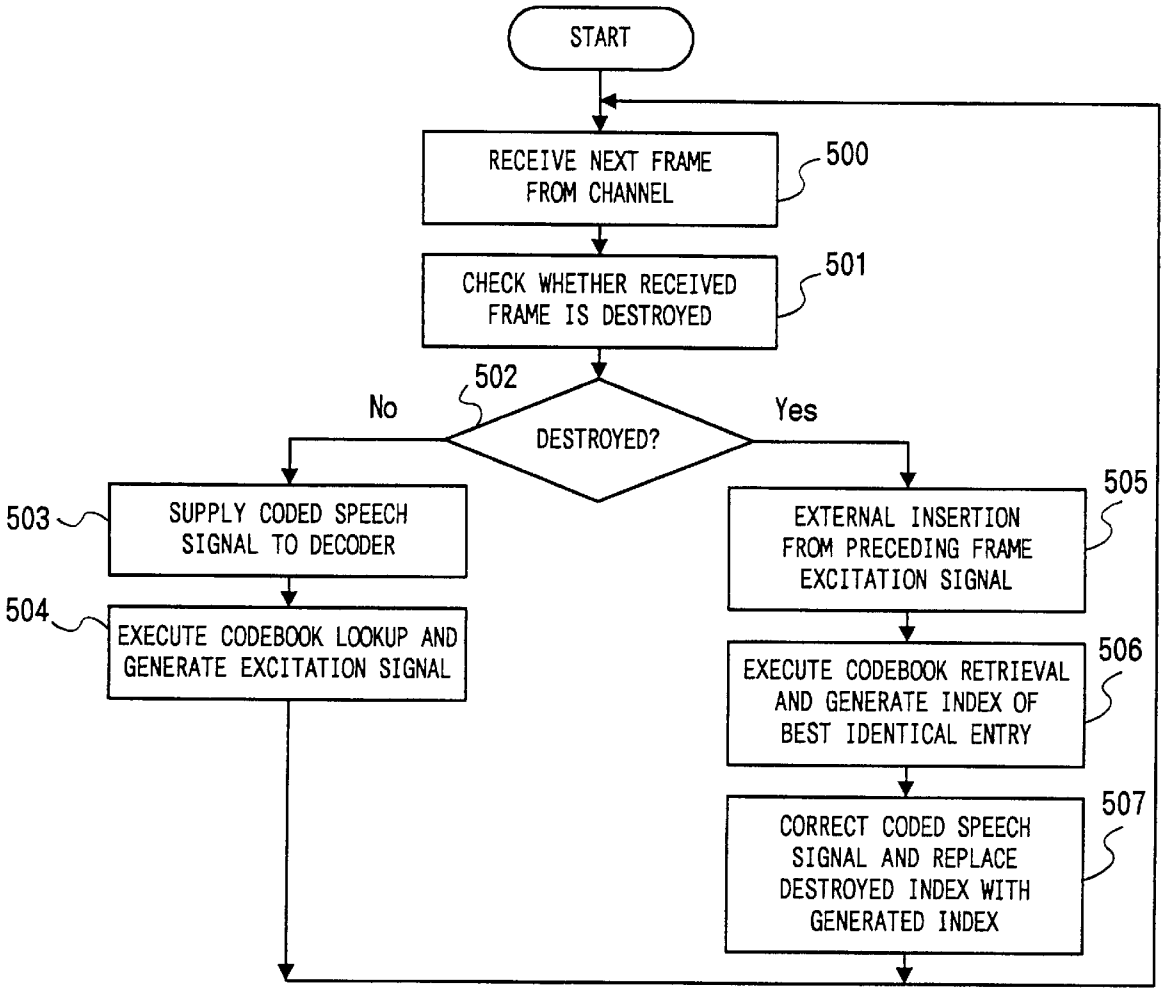
FIG.5 (PRIOR ART)
FIG. 5 is a flow chart concerning the operation of the decoder pre-processor in the prior art.

FIG. 2 is a block diagram showing a coder embodying the invention. Referring to FIG. 2, reference numeral 201 designates block diagram showing a coder, and 202 a block diagram showing a decoder.

The coder 201 includes two different codebooks, i.e., an adaptive codebook 204 and a fixed codebook 205. Multipliers 206 and 207 multiply excitation vector signal (i.e, pitch vector) and excitation output vector (i.e., codevector) supplied from the adaptive codebook 204 and the fixed codebook 205 by respective gains (i.e., pitch gain and code gain), and an adder 208 generates the excitation signal of the current frame by adding together the two product outputs of the multipliers. The pitch vector from the adaptive codebook 204 includes a component dependent on the periodicity of the speech signal, and the codevector from the fixed codebook 205 contains a non-periodic component. A vector is selected and provided by each codevector, which is constituted by a plurality of vector patterns. The adaptive codebook 204 is of the type for signal generation according to indexes as shown in FIG. 1 and described earlier, and supplies the past excitation signal generated in the adaptive codebook generator 203 to the adaptive codebook 204.

The excitation signal of the current frame is supplied to a weight multiplication synthesizing filter 209 and subjected for short period prediction in a linear prediction or like process to generate a reproduced signal. A subtracter 210 receives the reproduced signal and determines an error thereof for an acoustical weight multiplication processed input signal. This error is supplied to an error power evaluator 211.

The error power evaluator 211 controls and scans the outputs of the adaptive and fixed codebooks 204 and 205 and the gains of the multipliers 206 and 207 for each frame, and determines an excitation signal corresponding to a minimum error to be the optimal excitation signal.

The decoder 202 can be realized by omitting the subtracter 210 and the error power evaluator 211 from the construction of the coder 201 and replacing the weight application synthesizing filter with a synthesizing filter free from weight application. A post-filter 218 is cascade connected to the output of the synthesizing filter to generate a reconstituted speech signal for the purpose of improving the sound quality of the decoder.

The coder 201 transmits the pitch and code vector parameters supplied from the adaptive and fixed codevectors 204 and 205 at the time of the optimum excitation signal determination, the gain parameters for multiplication in the multipliers 206 and 207 and filter coefficients before weight application process in the weight application synthesizing filter 209, as coded index data of the input signal, to the decoder 202. The decoder 202, receiving these index data, operates an adaptive and a fixed codebook 213 and 214 in the decoder 202 corresponding to the coder 201, multipliers 215 and 216 for gain multiplying the vectors from the codebooks, a synthesizing filter 218 based on a short period prediction process and a post-filter 219 according to the received parameters and filter coefficients (generated from the index data), thus obtaining a reconstituted speech signal which best approximates the input speech.

In applications to radio communication systems, transmission errors may occur on the communication channel, on which the index data are transmitted from the coder 201 to the decoder 202, due to multi-fading or like problems. The transfer function of the prior art adaptive codebook is $P1(z)=CpZ^{-P}$. As is seen from this equation, once an error occurs, its detrimental effects are subsequently continued. In the equation, P is the group delay, i.e., pitch lag. Occurrence of a transmission line error may result in failure of identity of the internal states of the adaptive codebooks of the coder 201 and the decoder 202. In the occasion that the input speech to the coder at the time of the error occurrence is non-voiced signal or sole background noise, the error has less adverse detrimental effects. However, in such occasion as a sudden pitch lag change during voiced speech, the error has very great adverse effects, thus resulting in great departure of the contents of the adaptive codebooks of the coder and the decoder from each other. When decoding is made in such different states of the codebooks, the reconstituted speech signal of the decoder may contain noise even in the execution of retrieval for the best identical code in the coder.

When the adaptive codebook according to the present invention is used, the disadvantages of the error are determined by the number of preceding frame indexes that have used an excitation signal generation anew. In the embodiment, the adaptive codebook is generated by using indexes for 10 frames. This means that the disadvantages of the error are continued for only 10 frames. Thus, in the event of communication line error occurrence, it is possible to reduce generation of abnormal sound due to failure of identity of the internal states of the adaptive codebooks of the coder and the decoder.

A first advantage of the present invention is attributable to generation of the adaptive codebook, i.e., the excitation signal, anew from index data of at least one frame. By so doing, when several frames subsequent transmission line error occurrence have passed in the error-free state, it becomes possible to make the internal states of the adaptive codebooks of the coder and the decoder to be identical. With the coder and decoder adaptive codebook internal states made identical again subsequent to the lapse of the number of index storage frames after the occurrence of a transmission line error, unlike the existing adaptive codebook, the adverse effects of the error will not continue up to a non-voice period after the error occurrence. It is thus possible to reduce the probability of abnormal sound generation the co failure of identity of the coder and decoder codebooks. This advantage is particularly pronounced in the occasion of transmission error generation during voiced speech period. This is so because the adaptive codebook does not constitute a perfect feedback loop but the excitation signal is generated according to index data for a certain period of time.

A second advantage of the present invention is that it is possible to reduce the memory capacity necessary for holding the adaptive codebook internal state data at all times. This means that it is possible to reduce memory, which need be otherwise provided in the base station for such purposes as speech coding of several channels. This advantage permits memory provision as a single digital signal processor (DSP) chip (that is, it permits processing without provision of any external memory but with the sole DSP internal memory).

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. An adaptive codebook generator in a coder of CELP for coding a speech signal or audio signal to index data, and also in a decoder for decoding the index data to the speech signal or audio signal, comprising:

an index memory that provides a fixed codebook index preceding by i frames, an adaptive codebook index and gain indexes;

a first fixed codebook that provides a first signal series according to the fixed codebook index preceding by i frames;

an excitation signal memory that provides a second signal series according to the adaptive codebook index preceding by i frames;

an excitation signal generator that generates an excitation signal of at least one frame by using the outputs of the first fixed codebook and the excitation signal memory and the gain indexes; and a first adaptive codebook that produces an adaptive codebook signal on the basis of the output of the excitation signal memory;

the coder further comprising:

a second adaptive codebook that produces an excitation vector signal corresponding to pitch vector including a component dependent on a periodicity of the speech signal;

a second fixed codebook that produces an excitation output vector corresponding to a codevector of a non-periodic component of the speech signal;

a first and a second multiplier that respectively multiply the excitation vector signal and excitation output vector by respective first and second gains;

an adder that generates an excitation signal of a current frame by adding together the two product outputs of the first and second multipliers;

a synthesizing filter that generates a reproduced signal based on the excitation signal of the current frame;

a subtracter, responsive to the reproduced signal, that produces an error between the reproduced signal and an input signal; and an error power evaluator that controls and scans the outputs of the second adaptive and fixed codebooks and the gains of the first and second multipliers for each frame, and that produces an excitation signal corresponding to a minimum error to be the optimal excitation signal, wherein data stored in the excitation signal memory is updated according to the excitation signal.

2. An adaptive codebook generator in a coder of CELP for coding a speech signal or audio signal to index data, and also in a decoder for decoding the index data to the speech signal or audio signal, comprising:

an index memory that provides a fixed codebook index preceding by i frames, an adaptive codebook index and gain indexes;

a first fixed codebook that provides a first signal series according to the fixed codebook index preceding by i frames;

an excitation signal memory that provides a second signal series according to the adaptive codebook index preceding by i frames;

an excitation signal generator that generates an excitation signal of at least one frame by using the outputs of the first fixed codebook and the excitation signal memory and the gain indexes; and a first adaptive codebook that produces an adaptive codebook signal on the basis of the output of the excitation signal memory;

the decoder further comprising:

a second adaptive codebook that produces an excitation vector signal corresponding to pitch vector including a component dependent on a periodicity of the speech signal;

a second fixed codebook that produces an excitation output vector corresponding to a codevector of a non-periodic component of the speech signal;

a first and a second multiplier that respectively multiply the excitation vector signal and excitation output vector by respective first and second gains;

an adder that generates an excitation signal of a current frame by adding together the two product outputs of the first and second multipliers;

a synthesizing filter that generates a reproduced signal based on the excitation signal of the current frame; and a post-filter, cascade connected to the output of the synthesizing filter, that generates a reconstituted speech signal signal, wherein data stored in the excitation signal memory is updated according to the excitation signal.

* * * * *